US006211759B1

(12) United States Patent
Little et al.

(10) Patent No.: US 6,211,759 B1
(45) Date of Patent: Apr. 3, 2001

(54) IONIZED GAS DEFLECTOR FOR A MOLDED CASE CIRCUIT BREAKER

(75) Inventors: David E. Little, Beaver Falls; David C. Funyak, Irwin; Craig J. Puhalla, Coraopolis, all of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/481,421

(22) Filed: Jan. 12, 2000

(51) Int. Cl.[7] ..... H01H 9/02
(52) U.S. Cl. ..... 335/202; 439/810
(58) Field of Search ..... 335/6, 8–10, 16, 335/132, 202; 200/293–308; 439/810–814; 218/35–37

(56) References Cited

U.S. PATENT DOCUMENTS 4,181,836 * 1/1980 Miracle ..... 218/22
4,603,376 * 7/1986 Maier ..... 439/810
4,620,076 10/1986 Mrenna et al. .
5,753,877 * 5/1998 Hartzel et al. ..... 218/22
5,978,208 * 11/1998 Helms et al. ..... 361/669

* cited by examiner

*Primary Examiner*—Lincoln Donovan
(74) *Attorney, Agent, or Firm*—Martin M. Moran

(57) ABSTRACT

A gas deflector for a line-in connector of a circuit breaker. The gas deflector is coupled to a collar with a top and a cavity, a threaded opening through the top, a screw threaded in the threaded opening. The collar is attached to the line-in for the circuit breaker. The gas deflector is an L-shaped shield with an integral screw sleeve and a slot sized to allow a terminal strap to pass therethrough. The terminal strap is connected to the collar. The shield device covers the collar top and the cavity and is held in place by the screw passing through the sleeve and by the terminal strap passing through the slot. The shield substantially reduces the amount of ionized gas infiltrating into the collar.

6 Claims, 4 Drawing Sheets

IONIZED GAS DEFLECTOR FOR A MOLDED CASE CIRCUIT BREAKER

BACKGROUND OF THE INVENTION

1. Field of the Invention

This invention relates to a circuit breaker and, more specifically, to a shield structure which directs ionized gases, created by separation of the circuit breaker's contacts, away from a collar assembly coupled to the line side of a circuit breaker.

2. Description of the Prior Art

Molded case circuit breakers are generally known in the art. Such circuit breakers are used to protect electrical circuits from damage due to an overload, a short circuit or both. Circuit breakers typically have a molded plastic housing enclosing at least one pair of separable contacts including a fixed contact and a moveable contact. During an overload or a short circuit, the circuit breaker will trip causing the contacts to separate thereby opening the circuit. Additionally, the circuit breaker may be tripped manually should the need arise.

When the electrical contacts within a circuit breaker separate, an electrical arc may form between the contacts creating hot ionized gases. The ionized gases formed by an electrical arc are conductive. If these ionized gases collect in the vicinity of the line terminals of the circuit breaker, they may establish a conduction path between the terminals connected to different phases of the line current, or between the terminals and an electrical ground. Such a connection can lead to electrical faults on the line side of the circuit breaker and damage the equipment. Circuit breakers typically include vents to allow the ionized gases to quickly escape as well as a shield to protect a collar assembly which connects the line to the terminal strap or contact.

A collar assembly will generally have a four sided collar defining a cavity. The collar is attached to the terminal strap which incorporates the fixed contact of the circuit breaker. The collar will also have a screw, or other such device, which may be used to clamp the line end against the terminal strap. The collar and the line end are in close proximity to the contact point of the circuit breaker and, when the circuit is broken, ionized gases are in the immediate vicinity of the line end and collar assembly. To deflect the ionized gasses away from the collar assembly and towards a vent, most collar assemblies include a gas deflector.

Prior art gas deflection devices include a generally L-shaped paper shield mounted on top of the collar which overlays the contact side of the collar, as well as a separate plastic sleeve disposed about the screw and passing through the paper shield. This design has several disadvantages. For example, because the paper shield device is not coupled to the collar assembly, it can easily be accidentally removed. Also, because the paper shield is not fixed, it may move within the circuit breaker housing, allowing a path for ionized gases to reach the collar assembly and line. Because the screw sleeve is not integral to the paper shield, another path for ionized gases to contact the collar assembly could exist through the screw sleeve hole in the paper shield. Additionally, because the paper shield and screw sleeve are separate components, there is an additional cost associated with assembling the device.

There is a need for a gas deflection device to isolate the line end terminals of a circuit breaker from each other and areas adjacent to the circuit breaker to substantially reduce the amount of ionized gases infiltrating into those spaces.

There is a further need for a gas deflection device which is compatible with collar assemblies presently used on circuit breakers.

There is a further need for a gas deflection device which is inexpensive and may be conveniently installed within a circuit breaker.

SUMMARY OF THE INVENTION

The present invention satisfies the above referenced needs by providing a one piece shield which protects the collar assembly from ionized gases. The shield has an integral sleeve which provides access for the mounting screw. Additionally, the shield is provided with a slot allowing the terminal strap to pass therethrough. The shield is made of a rigid material, such as plastic. The shield is held in place at one end by the sleeve and at the other end by the terminal strap passing through the shield. Thus, the shield is less likely to be subject to deflection than a paper shield.

DESCRIPTION OF THE PREFERRED EMBODIMENT

Figure 1:
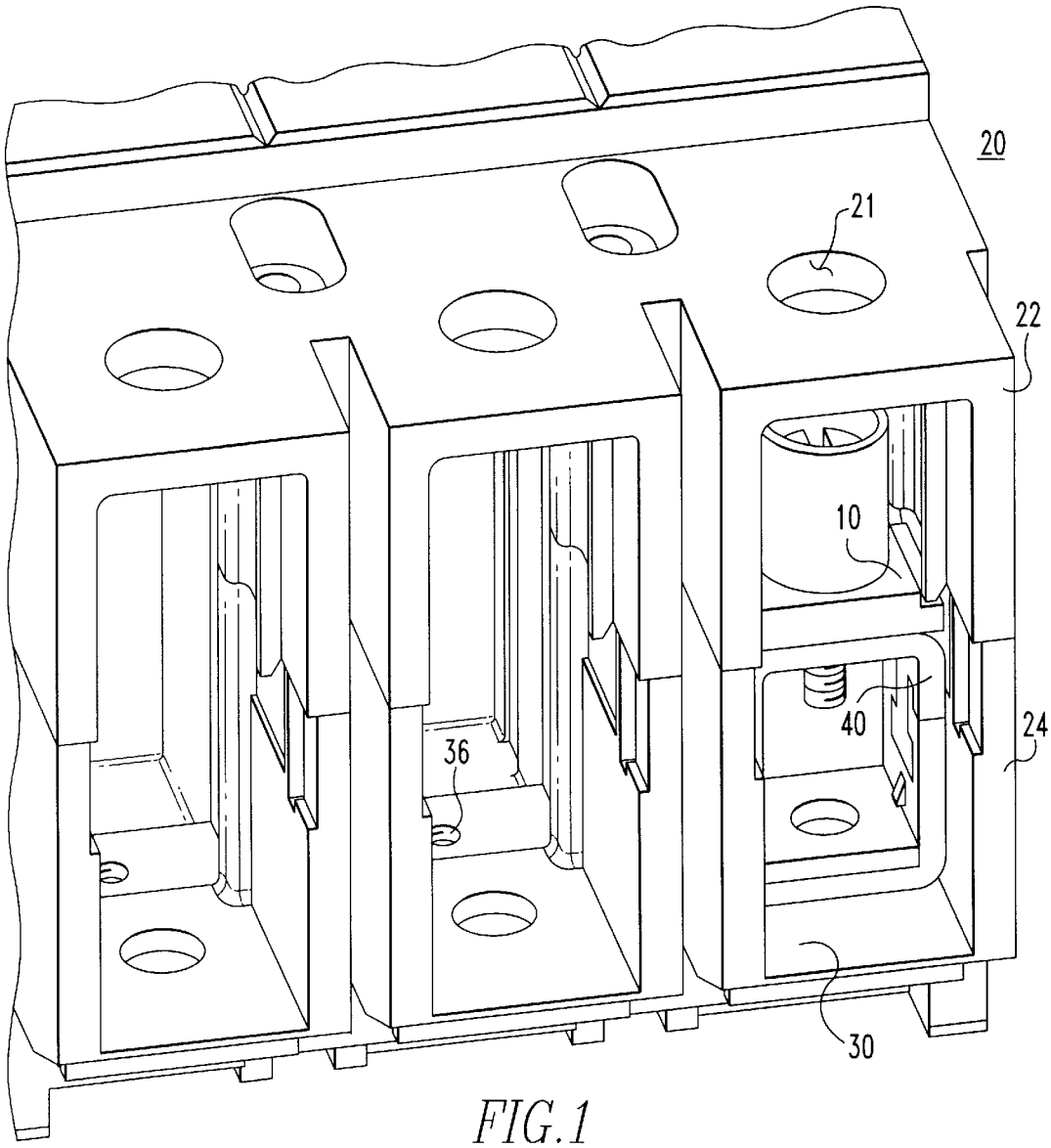
FIG. 1 shows a perspective view of the gas deflection device and collar assembly mounted within a circuit breaker housing.
Figure 2:
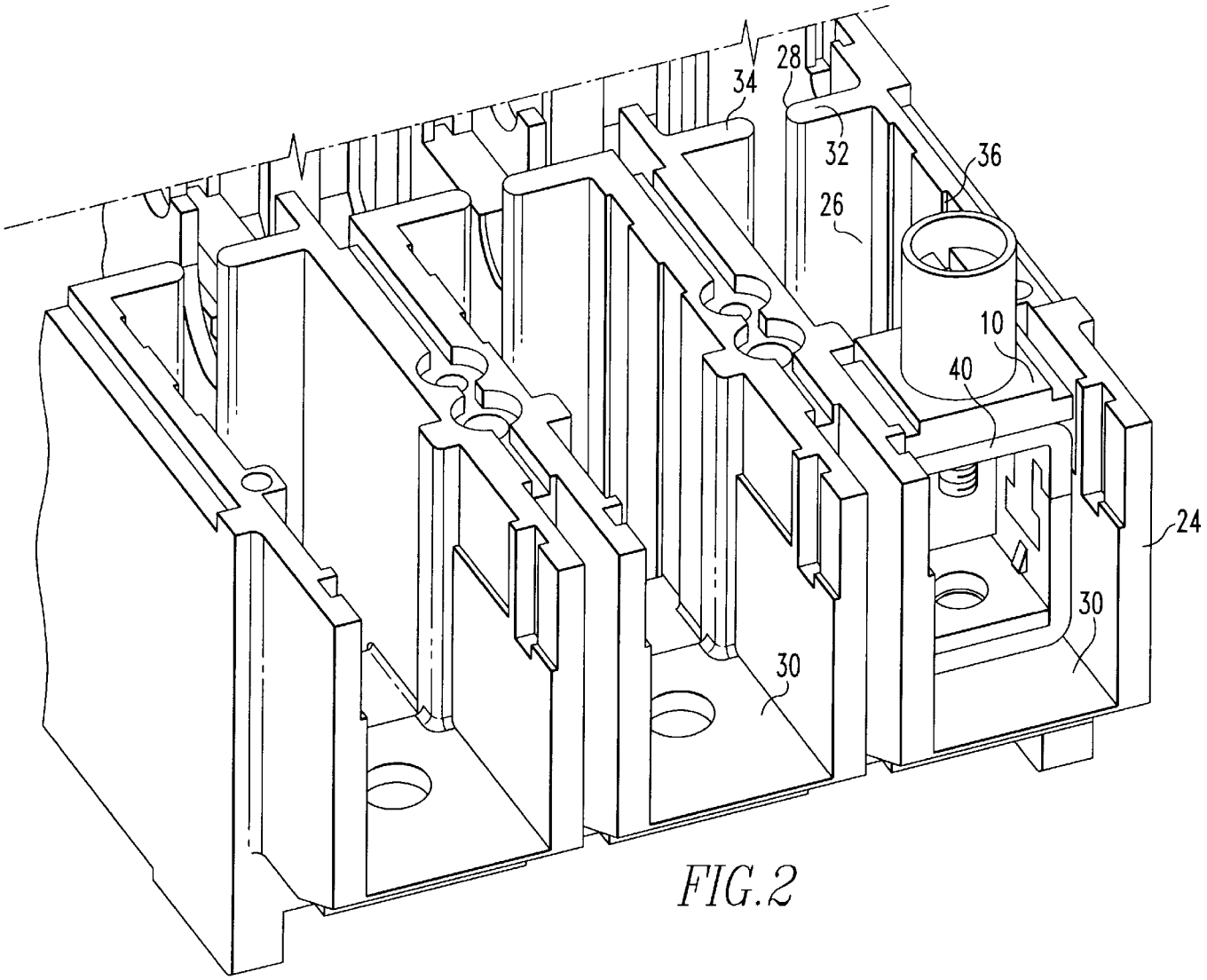
FIG. 2 shows a perspective view as in FIG. 1, with the top portion of the circuit breaker housing removed.

A shield device 10 according to the present in invention is shown disposed within a circuit breaker housing 20 in FIGS. 1 and 2. The circuit breaker housing 20 includes a top portion 22 and a bottom portion 24 forming an arc chamber 26, an movable contact chamber 28, a collar assembly recess 30 and separation ribs 32, 34. A terminal assembly 40 fits mainly within the collar assembly recess 30, with a terminal strap 80 extending between separation ribs 32, 34 and into the arc chamber 26. Within the arc chamber 26 is a fastener hole 36. A fastener 38 passes through a fastener hole 90 on a terminal strap 80 into fastener hole 36 thereby attaching the terminal assembly 40 to the circuit breaker housing bottom portion 24.

Figure 3:
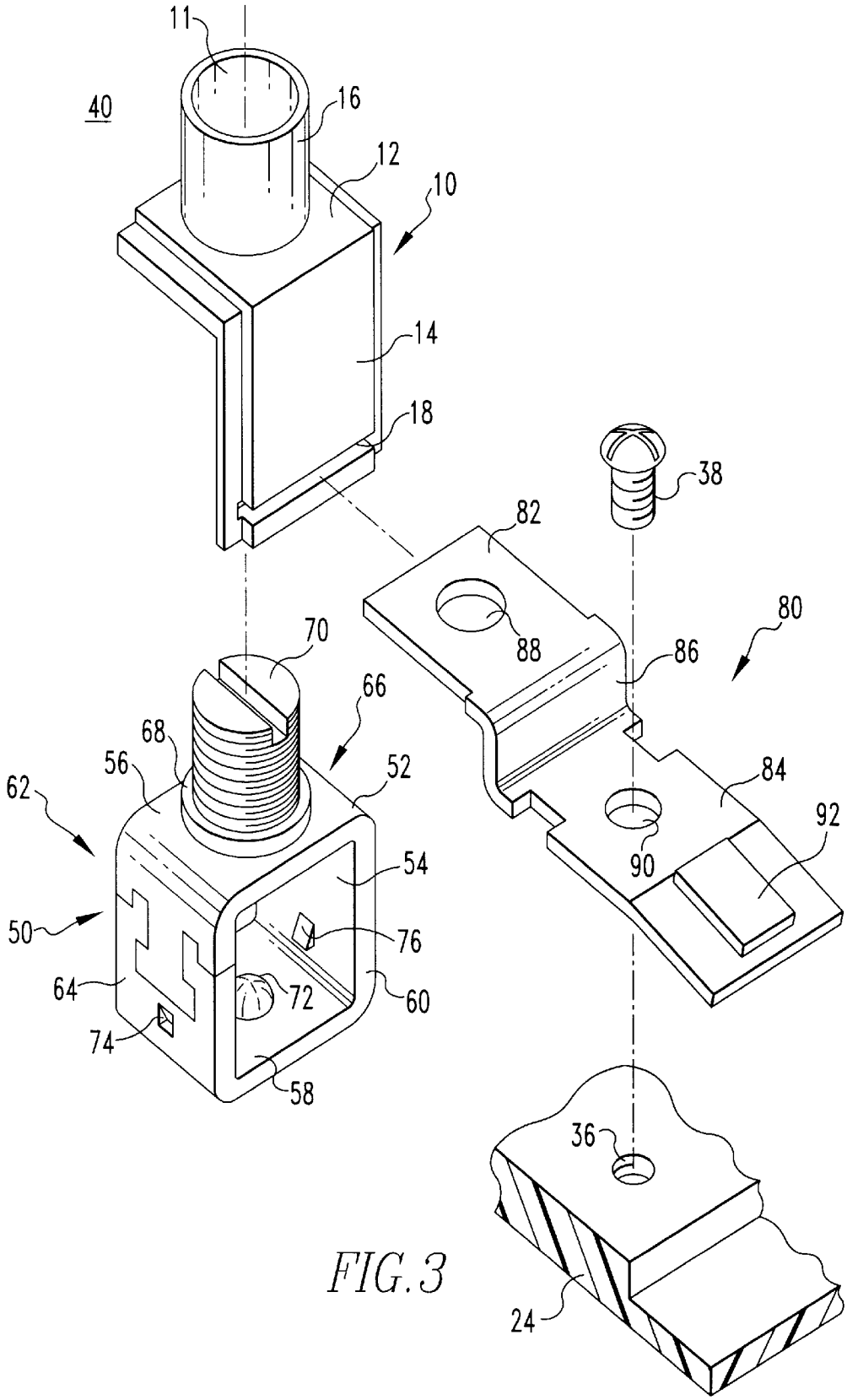
FIG. 3 is an exploded view of a terminal assembly.

As shown in FIG. 3, the terminal assembly 40 for a circuit breaker includes a collar assembly 50, a shield device 10 and a terminal strap 80. The collar assembly has a four-sided collar 52 defining a cavity 54 with openings on the opposing first face 60 and second face 62. As used herein, the first face 60 refers to the face of the collar 52 that will be adjacent to the arc chamber 26 when the terminal assembly 40 is installed in circuit breaker housing 20. Conversely, the second face 62 of the collar 52 will be adjacent to the line-in when the terminal assembly 40 is installed in circuit breaker housing 20. The collar 52 also includes a top 56, a bottom 58, and two sides 64, 66. The collar top 56 has a threaded opening therethrough with an annular ridge 68 disposed about the threaded opening. A screw 70 is engaged with the threaded opening and passes through the collar top 56 into the cavity 54. The screw 70 may be adjusted vertically through the collar top 56. The collar bottom 58 has a detent 72 which protrudes into cavity 54. Each collar side 64, 66 has a projection 74, 76 into cavity 54. The projections 74, 76 are located proximal to the collar bottom 58.

Figure 4:
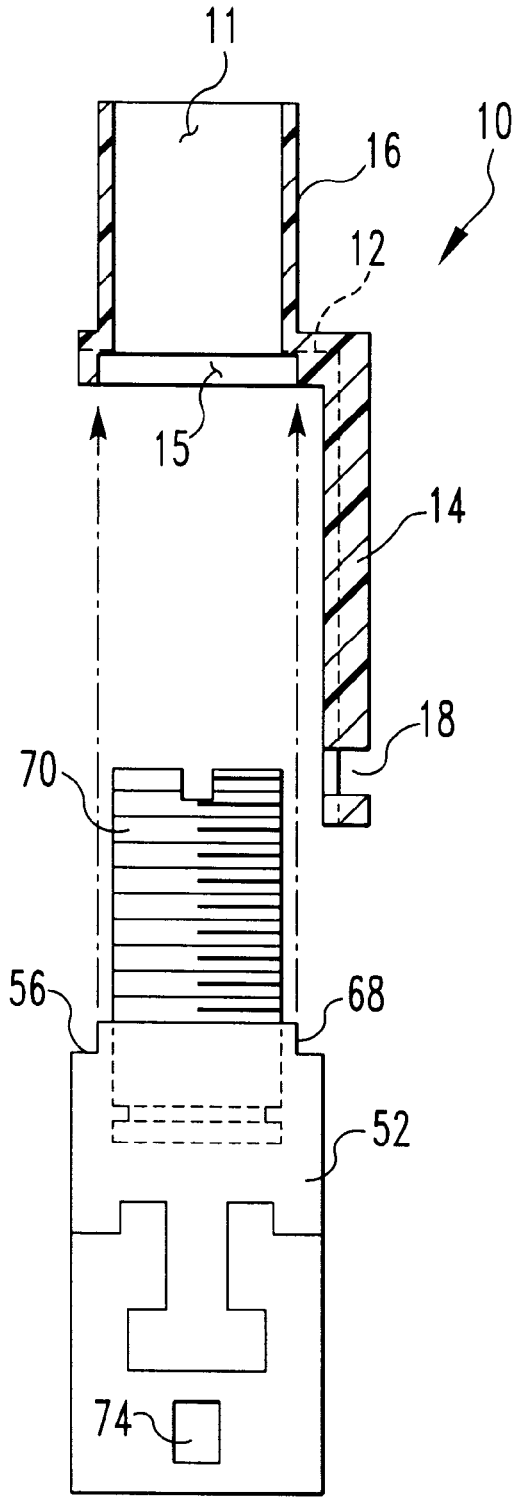
FIG. 4 is a cross sectional view of the shield.

The shield device 10 is a member having a top plate 12 and a perpendicular side plate 14. The top plate 12 is sized to cover the collar top 56, while the side plate 14 is sized to cover the collar first face 60 and cavity 54. The top plate 12 further includes an opening 11, a screw sleeve 16 disposed about opening 11 which is sized to fit about screw 70. As shown on FIG. 4, the lower side 13 of the top plate 12 has a circular recess 15 which has a diameter slightly larger than the annular ridge 68. The side plate 14 includes a slot 18 at its distal end. The slot 18 is sized to allow the terminal strap 80 to pass therethrough. The shield device 10 is preferably made from a dielectric material.

As shown on FIG. 3, the terminal strap 80 includes a line-in tab 82 and a contact tab 84 connected by a medial portion 86. The line-in tab 82 and the contact tab 84 are approximately in parallel planes while the medial portion 86 is perpendicular to such planes. As such, the terminal strap 80 has a Z-shape. The line-in tab 82 includes an opening 88 therethrough which is sized to fit about the detent 72 located on the collar bottom 58. The contact tab 84 includes a fastener opening 90 and the stationary contact point 92. In operation, the contact point 92 would touch the movable contact of the load side of the circuit breaker.

When assembled, the shield device 10 covers the collar top 52 and the first face 60 and the cavity 54. The screw sleeve 16 fits over the screw 70 and the recess 15 encircles the annular ridge 68. The terminal strap 80 passes through the terminal strap slot 18. When assembled, the terminal strap is partially secured by detent 72 on housing bottom 58 which is disposed in opening 88. Additionally, the terminal strap 80 is held by projections 74, 76.

As noted above, and as shown in FIG. 1, a circuit breaker housing top portion 22 is attached to the circuit breaker housing bottom portion 24. The circuit breaker housing top portion 22 has chambers corresponding to the arc chamber 26, the movable contact chamber 28, the collar assembly recess 30 as well as has a screw access hole 21 positioned over screw 70. The line side cable (not shown) fits within cavity 54 of the collar assembly 50. The cable is secured within the collar assembly 50 by tightening screw 70 thereby clamping the cable against line-in tab 82 of terminal strap 80. The load side of the circuit breaker is coupled to the moveable contact assembly (not shown) which is mounted adjacent to the movable contact chamber 28 and which has a contact passing into the arc chamber 26 which touches contact point 92 of terminal strap 80 when the circuit breaker is in the closed position.

In operation, the contacts will be closed. When a current interruption occurs in the circuit breaker, or when the circuit breaker is intentionally tripped, the electrical contacts separate and may form an electric arc therebetween. The electrical arc may create ionized gases which can conduct electricity. These gases are initially in the arc chamber 26 but may travel to the collar assembly chamber 40. A substantial amount of these gases, however, are prevented from reaching the collar assembly 50 by shield device 10. Because the shield device 10 substantially covers the collar assembly 50, the gases will pass over the shield device 10 and exit the circuit breaker housing 20 through the back of the collar recess 30.

While specific embodiments of the invention have been described in detail, it will be appreciated by those skilled in the art that various modifications and alternatives to those details could be developed in light of the overall teachings of the disclosure. Accordingly, the particular arrangement disclosed are meant to be illustrative only and not limiting as to the scope of the invention which is to be given the full breath of the appended claims and any and all equivalence thereof.

What is claimed is:

1. A gas deflecting terminal assembly for a circuit breaker comprising:

a collar having a top, and a cavity;

said cavity having an opposing first face and second face, each face having an opening to said cavity;

a threaded opening through said collar top;

a screw, threaded in said threaded opening;

a shield device having a top plate and a perpendicular side plate;

said top plate having an opening therethrough and an integral screw sleeve;

a terminal strap;

said terminal strap connected to said collar;

said shield device coupled to said collar with said top plate covering said collar top, said side plate covering said first face and said first face cavity opening; and;

wherein said shield device side plate has a slot passing therethrough and said terminal strap passes through said slot.

2. The terminal assembly of claim 1, wherein said collar top includes an annular ridge disposed about said threaded opening and said shield device includes a recess disposed about said top plate opening, where said recess has a diameter larger than said annular ridge.

3. The terminal assembly of claim 2, wherein;

said collar has a bottom and two sides forming said cavity;

said collar bottom having a detent protruding into said cavity;

said collar sides each having a projection into said cavity;

said terminal strap having a opening corresponding to said detent;

wherein said terminal strap is frictionally held in said collar by said detent and said projections.

4. A circuit breaker comprising;

a circuit breaker housing having an arc chamber and an adjacent collar recess communicating with said arc chamber;

a collar assembly comprising:

a collar having a top and a cavity;

said cavity having an opposing first face and second face, each face having an opening to said cavity;

said collar seated in said collar assembly recess with said first face adjacent to said arc chamber;

a threaded opening through said collar top;

a screw threaded in said threaded opening;

a shield device having a top plate and a perpendicular side plate;

said top plate having an opening therethrough and an integral screw sleeve;

a terminal strap coupled to said collar extending from said arc chamber into said cavity through said first face opening;

said shield device coupled to said collar with said top plate covering said collar top, said side plate covering said first face and said first face cavity opening; and wherein said shield device side plate has a slot passing therethrough and said terminal strap passes through said slot.

5. The circuit breaker of claim 4, wherein;

said collar top includes an annular ridge disposed about said threaded opening and said shield device includes a recess disposed about said top plate opening, where said recess has a diameter larger than said annular ridge.

6. The circuit breaker of claim 5, wherein said collar has a bottom and two sides forming said cavity;

said collar bottom side having a detent protruding into said cavity;

said collar sides each having a projection into said cavity;

said terminal strap having a opening corresponding to said detent;

wherein said terminal strap is frictionally held in said collar by said detent and said projections.

* * * * *